United States Patent [19]

Kennedy

[11] Patent Number: 4,726,429

[45] **Date of Patent: * Feb. 23, 1988**

[54] PERCUSSION DOWN HOLE DRILLING TOOL WITH CENTRAL FLUID FLUSHING PASSAGE

[76] Inventor: James D. Kennedy, P.O. Box 140, Wentworth, Mo. 64873

[ * ] Notice: The portion of the term of this patent subsequent to Sep. 22, 2004 has been disclaimed.

[21] Appl. No.: 630,670

[22] Filed: Jul. 13, 1984

[51] Int. Cl.[4] ..... B25D 17/14

[52] U.S. Cl. ..... 173/62

[58] Field of Search ..... 173/78, 79, 80, 73; 175/99, 100, 296, 92, 84, 107, 293; 91/51, 52, 239, 398; 92/110

[56] References Cited

U.S. PATENT DOCUMENTS

| | | | |
|---|---|---|---|
| 1,293,081 | 2/1919 | Gilman | 173/62 |
| 1,734,984 | 11/1929 | Smith, Sr. et al. | 91/239 X |
| 1,777,334 | 10/1930 | Smith, Jr. | 91/239 X |
| 3,045,768 | 7/1962 | Huffman . | |
| 3,149,540 | 9/1964 | Lindgren et al. | 92/110 X |
| 3,503,459 | 3/1970 | Schindler . | |
| 3,595,323 | 7/1971 | Schnidler . | |
| 3,924,690 | 12/1975 | Shaw . | |
| 4,044,844 | 8/1977 | Harris et al. . | |
| 4,106,571 | 8/1978 | Stone | 173/64 |
| 4,194,581 | 3/1980 | Walter . | |
| 4,209,070 | 6/1980 | Sudnishnikov et al. . | |
| 4,265,321 | 5/1981 | Hibbard . | |
| 4,280,570 | 7/1981 | Walter . | |

OTHER PUBLICATIONS

Catalog No. M500, TRW Mission, "Operation and Maintenance Manual", Percussion Drilling Equipment.

*Primary Examiner*—Paul A. Bell
*Assistant Examiner*—Willmon Fridie, Jr.
*Attorney, Agent, or Firm*—Kerkam, Stowell, Kondracki & Clarke

[57] ABSTRACT

A percussion drilling tool assembly is provided which operates under fluid pressure to reciprocating a hammer, the hammer is disposed in a barrel assembly and operates to strike an anvil bit shank to cause the bit to thereby penetrate a rock substrate material of central fluid passage through the drill stem of the assembly and through the reciprocating hammer allows a flushing fluid to be used with the drilling assembly to flush cuttings from the hole up and around the drill stem simultaneously with and separate from the fluid operating system for reciprocating the hammer.

9 Claims, 11 Drawing Figures

FIG 8
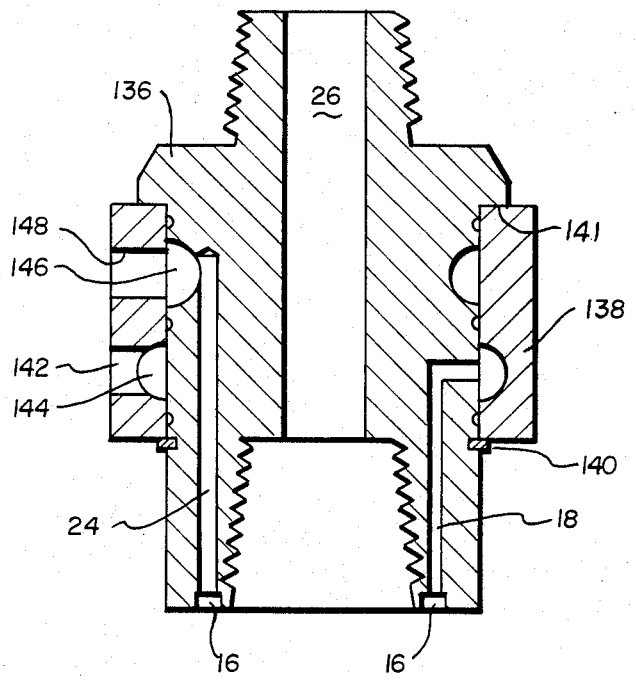
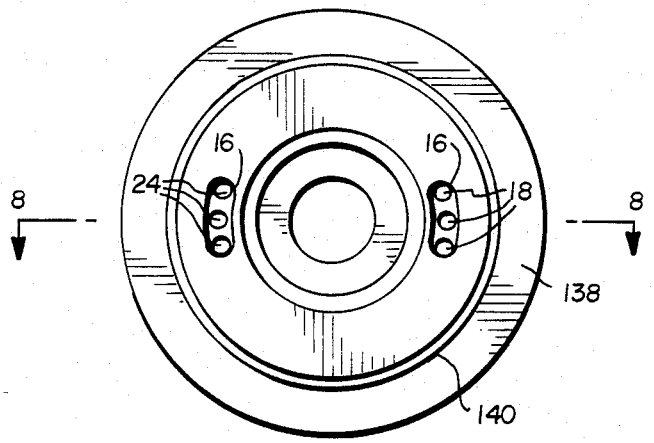
FIG 9

FIG. 10
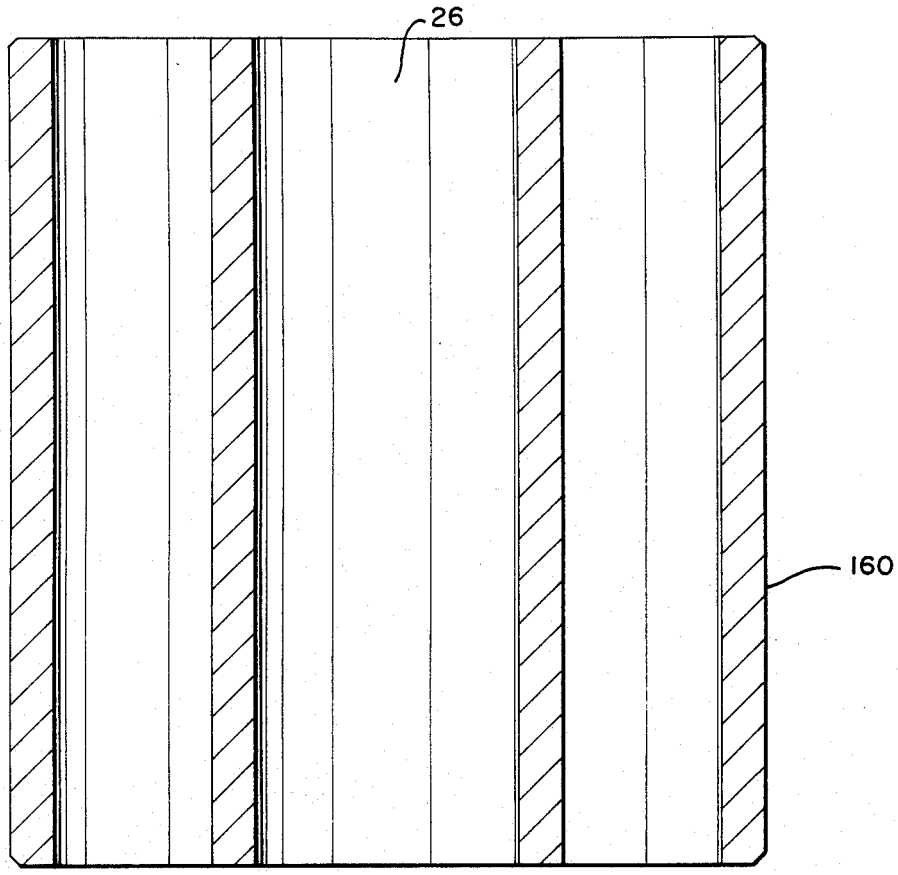
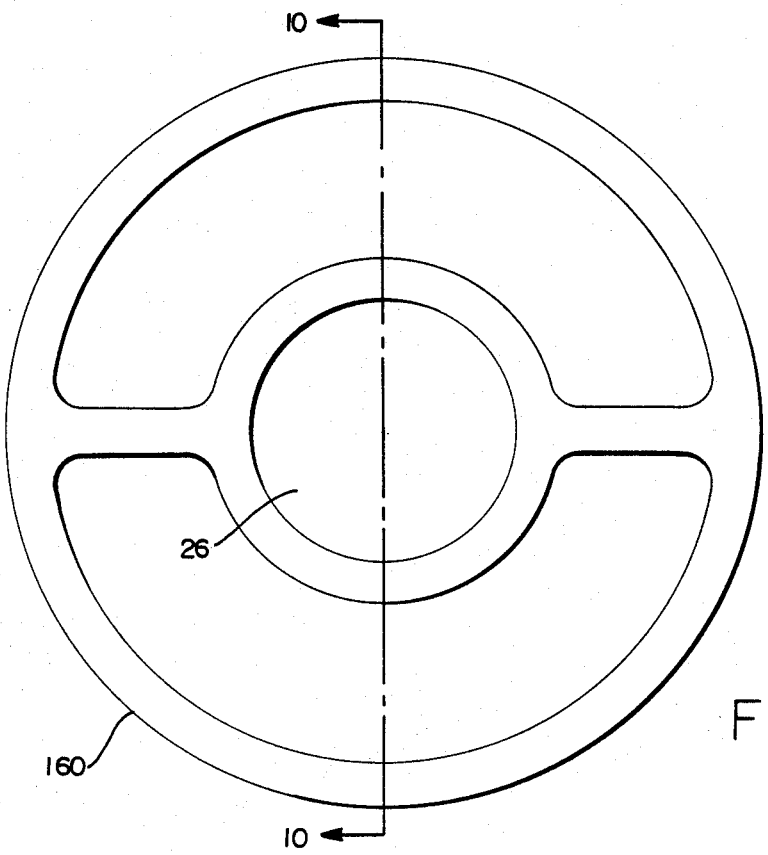
FIG. 11

PERCUSSION DOWN HOLE DRILLING TOOL WITH CENTRAL FLUID FLUSHING PASSAGE

BACKGROUND OF THE INVENTION

This invention relates to percussion drilling tools, sometimes referred to as down-hole-percussion drill motors, which are used for oil drilling and penetration of rock substrate, often to great depths. In such tools a motor casing is generally provided for housing a reciprocating piston member for hammering an anvil and bit shank piece by means of regulated air pressure.

In conventional drills of this type, such as shown in U.S. Pat. No. 3,503,459, the air pressure is released from the drill bit and forced together with the cuttings and any other debris including water up the annular space between the drill stem and the hole. In this way the bottom of the hole is continually flushed and kept relatively clean to enable it to be broken up by the pneumatic action of the reciprocating bit. In many instances, however, when increasing pressures are encountered at great depths in the form of subterranian water, a "flood out" condition will occur in which the water pressure at the bottom of the hole will be equal to or greater than the air pressure applied to the pneumatic hammer so that further progress is severly impeded if not curtailed due to the lack of pressure differential. When this occurs, the drill stem is usually tripped out of the hole and the pneumatic hammer and percussion bit are replaced with a rotatable tricone bit assembly in which the primary mode of penetration is rotary rather than reciprocal. This mode is less efficient and slower and requires a drill mud as a flushing agent for the cuttings, the mud being introduced usually through the drill stem and forced-out the drill bit and up the annular spacing between the drill stem and the hole. It should be apparent that tripping out of the hole and replacement of the bit requires a costly delay and effort in the drilling operation which most drill riggers try to avoid.

SUMMARY OF THE INVENTION

The primary object and purpose of the present invention is to provide a percussion drilling tool that will operate at depths much greater than conventional drilling tools allow without having to change over to a rotary drill assembly and without having to dispense with fluid pressure as the operating force of the system.

The present invention has for its ancilliary objects and benefits the use of a percussion drilling tool assembly which can operate in that mode while at the same time using a conventional drilling mud as a flushing agent for the hole. Further, in accordance with the principles of the invention, the air pressure for operating the hammer or piston assembly is maintained at an operating pressure within the confines of the drilling assembly and is never exposed to the bottom hole pressure conditions which often cause "flood out" in conventional percussion drilling systems. By means of the principles of the invention the precussion drill can be operated via a fluid pressure system which is always self contained and therefore separate from the flushing operation of a drilling mud if such is used with the invention. The invention therefore allows the hammer or piston assembly to be operated in several different ways—either by air alone, by air and mud, or by air and water. Also, when using a percussion bit, the bit may sheer requiring the drilling operation to cease until the tools are recovered. When this occurs, the drill assembly is provided with a fishing tool for retrieving the bit head, thus saving the hole.

In particular, the invention provides a drill stem having a central mud passage and an outer intake air and exhaust air passages. The mud passage allows mud to be passed through the drill stem, to enter the mud rod diposed in the hammer and let it pass through the hammer without coming in contact with any moving parts in the hammer. After passing through the hammer, the mud flows through the bit and flushes cuttings up the hole around the drill stem. The air is pumped through the intake passage provided in the drill stem, into the top sub of the hammer and then through an intake passage of the air distributor which directs it into the intake port of the hammer barrel wherein the air pressure activates the piston into a hammering motion. When the piston is on the exhaust cycle the air pressure is released into the exhaust ports of the hammer barrel, thus releasing the pressure and letting the piston return to the firing position.

The air released into the exhaust ports in the barrel returns to the air distributor which routes the exhausted air into the exhaust passage in the drill stem to be released at the top of the derrick, thus relieving any restriction of air which could be caused by an equalization of inside and outside pressure from a "flooding out" condition.

The invention will be better understood as well as further objects and advantages thereof become more apparent from the ensuing detailed description taken in conjunction with the drawings.

BRIEF DESCRIPTION OF THE DRAWINGS

FIG. 8 is an elevation view partly in cross section of the air and mud supply assembly that cooperates with the top portion of the assembly shown in FIG. 1; and FIG. 9 is a cross section of the assembly shown in FIG. 8.

FIGS. 10 and 11 show the drill stem.

DETAILED DESCRIPTION

Figure 1:
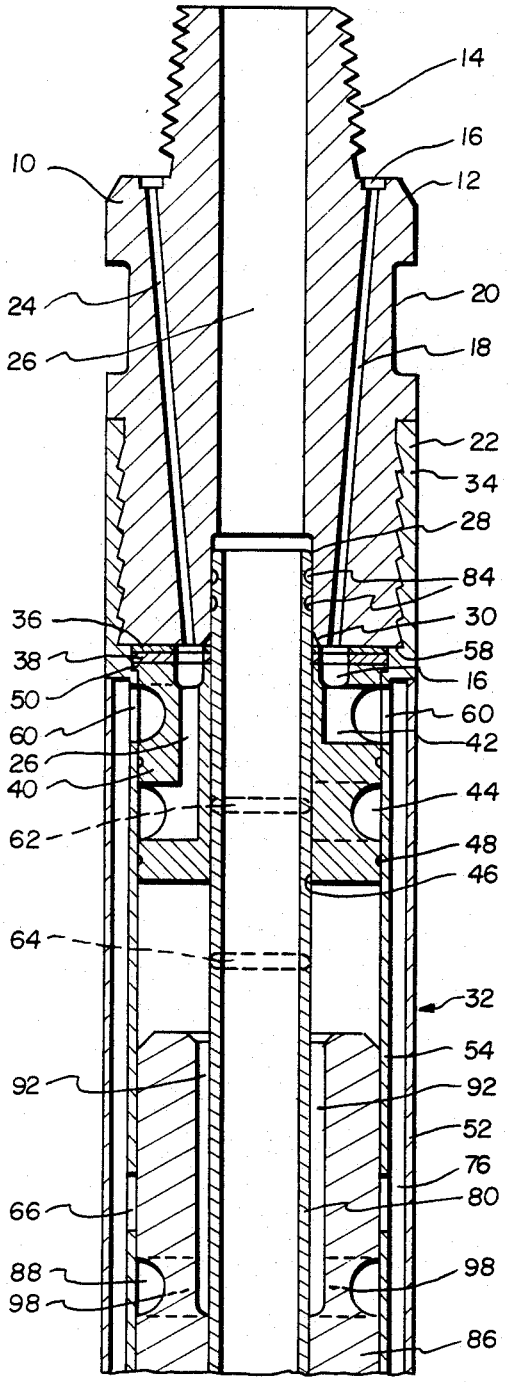
FIG. 1 is an elevation view with some parts broken away illustrating the upper half of the percussion drill assembly according to the invention.

Referring now to FIG. 1, there is shown a top sub asssembly 10 of the percussion drill according to the invention, having a chambered upper portion 12 and a threaded portion 14 for mating with an air supply member portion to be discussed below. A mating slot 16 is shown connecting with the fluid supply passage 18 extending generally axially of the sub assembly 10. A squared portion 20 is shown for receiving a wrench to enable the top sub to be appropriately fitted to its mating parts, for example the threaded portion 22 with the barrel assembly to be discussed below. Also shown is a fluid exhaust passage 24 and a central mud passage 26. At the lower end of the top sub is a mud rod seat 28 having a chambered edge 30 for receiving the mud rod to be discussed below.

The top sub 10 mates with the hammer barrel assembly 32 which has it upper portion engaging the threads 22. Between the two assemblies and contained within the periphery of the hammer barrel assembly 32 there is provided a top distributor ring member 36 superimposed with a rubber, or rubber-like, sealing ring 38, both of which have suitable apertures corresponding with the fluid supply and exhaust passages 18 and 24, as well as the mud passage 26. Beneath these ring members and also confined within the periphery of the hammer barrel assembly is a cylindrical fluid distributor assembly 40 having a fluid mating slots 16, similar to those described above, for communicating respectively with fluid supply passage 18 and fluid exhaust passage 26. Also shown is a circumferentially extending fluid intake groove 42 communicating with the fluid supply passage 18 and a circumferentially extending fluid exhaust groove 44 for communicating with the fluid exhaust passage 26. A mud rod clearance passage 46 is shown for accepting the mud rod assembly, and a suitable O-ring seal 48 is provided with lip portion 50 at its upper extent for positioning the member on a corresponding ledge portion of the barrel assembly.

Figure 2:
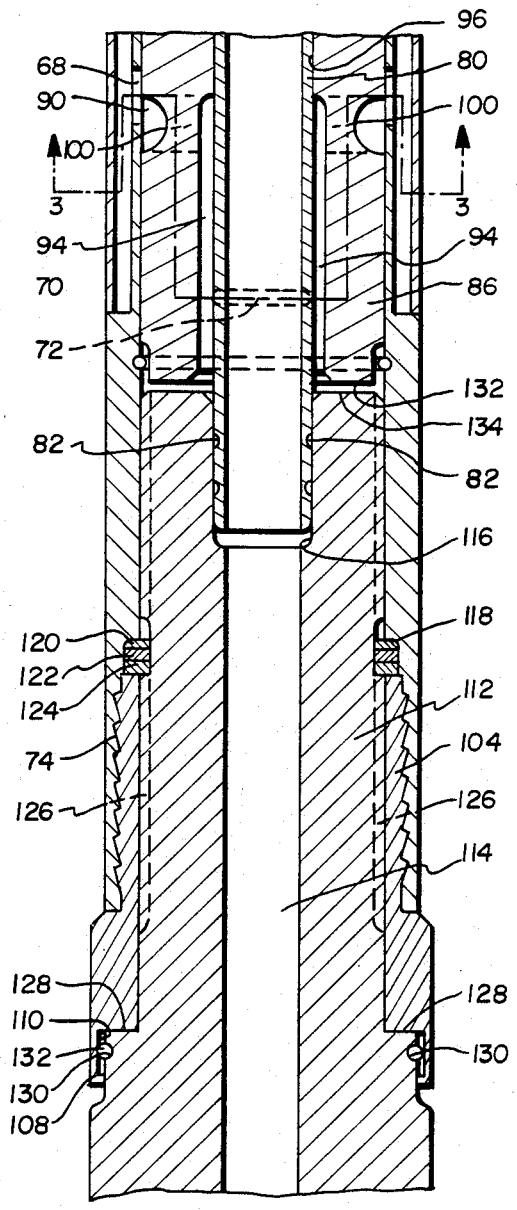
FIG. 2 is a similar view of FIG. 1 showing the lower half of the percussion drill assembly.
Figure 3:
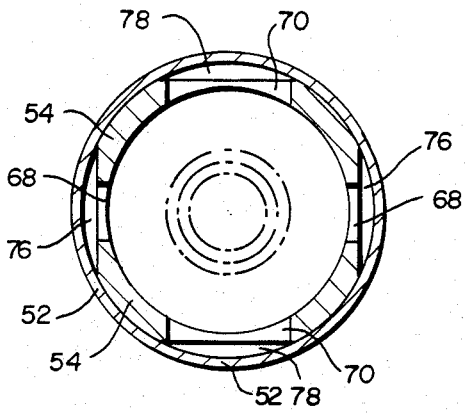
FIG. 3 is a cross section of the hammer barrel assembly shown in FIGS. 1 and 2.

Referring now to FIGS. 2 and 3 as well as FIG. 1 the hammer barrel assembly 32 is seen to constitute the middle portion of the percussion drill assembly, its upper end 34 mating with the threads 22 of the top sub assembly 10. An outer barrel 52 is shown surrounding an inner barrel 54 between which sets of air passages are to be discussed below. The bottom of the top sub 10 is seen to rest on the step 58 provided on the inner hub portion 34. A fluid intake port 60 and fluid exhaust port 62 is provided as shown, as well as a top fluid exhaust port 64 and a top fluid intake port 66. A corresponding bottom fluid intake port 68 and a bottom fluid exhaust port 70 is also provided as shown. A snap ring 72 is provided on the periphery of the outer barrel, which in turn is provided with threads 74 for engaging the upper portion of the bit shank assembly to be discussed below. In FIG. 2 the fluid intake chamber comprises diametrically opposed channels constituting one set of chambers, while another set of chambers constituting the fluid exhaust chamber 78, as seen in FIG. 3, is parallel to the intake chamber but shifted 90° about the long axis of the drill assembly.

Occupying the central portion of the hammer barrel 32 is a mud rod 80 extending the length of the barrel which surrounds the hammer assembly 86. The upper end fits in the mud rod seat portion 28 and the lower end in a seat portion of the bit shank, to be discussed below. Suitable O-ring seals 82 and 84 are provided respectively at the upper and lower peripheries of the mud rod for effecting sealing engagement with the inner peripheries of the respective upper and lower seat portions. The mud rod 80 provides a sealed passage for the drilling mud to flow through the percussion drill assembly without affecting the operation of the fluid passages, to be later desribed.

Figure 4:
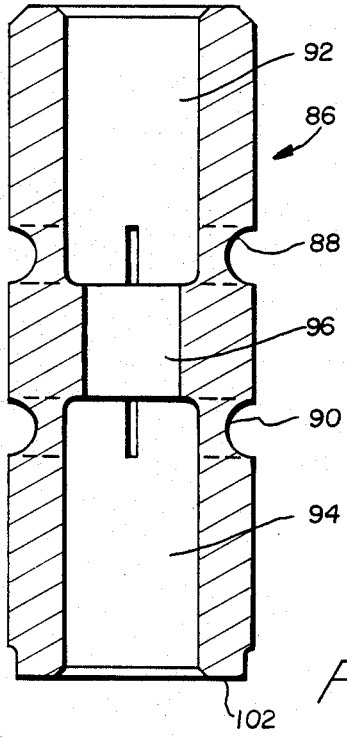
FIG. 4 is an elevation view partly in cross section of the piston or hammer member used in the percussion drill assembly.
Figure 5:
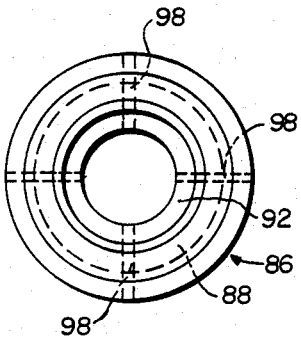
FIG. 5 is a cross section of the piston member shown in FIG. 4.

Occupying the central portion of the hammer barrel is mud rod 80 and axially slidable thereon is the hammer assembly 86, also shown in FIGS. 4 and 5. An upper fluid intake groove 88 circumferentially extends around the hammer, as shown, as well as a lower fluid intake groove 90. A fluid exhaust chamber 92 extends upwardly from a central portion 96 that axially engages the mud rod 80 and is defined respectively by the exterior wall of the mud rod 80 and the interior wall of the hammer 86. A similar passage 94 extends downwardly from the central portion 96. Also provided are fluid slots 98 and 100, shown in dotted line, adjacent the upper and lower fluid intake grooves 88 and 90. As best shown in FIG. 5, these slots are spaced apart by 90° about the central or long axis of the drill assembly. The bottom surface 102 of the hammer 86 is the impact surface which strikes the anvil to the bit shank to be later described.

Figure 6:
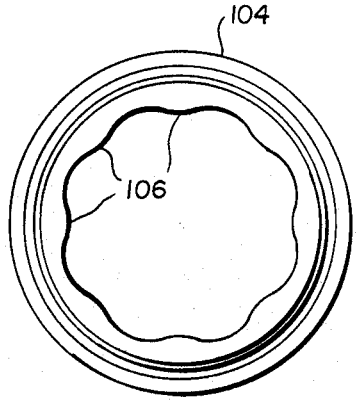
FIG. 6 is an end view of the driver sub assembly shown in FIG. 2.
Figure 7:
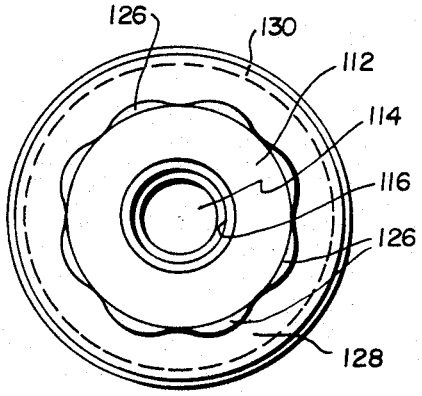
FIG. 7 is an end view of the bit shank assembly shown in FIG. 2.

At the lower portion of FIG. 2 is shown the driver sub 104 which is threadedly engaged with the lower extension of the barrel assembly 32. The driver sub comprises a cylindrical housing having circumferentially spaced splines 106 vertically extending along the interior wall surface thereof, as best shown in FIG. 6. The bottom of the driver sub is a radially extending lip member 108 which functions as a fishing tool to be later explained. A retaining surface 110 cooperates with a ball bearing means on the bit shank 112 which fits within the central interior space of the driver sub. The bit shank comprises a mud passage 114 which communicates with the mud passage defined by the mud rod 80 extending upwardly, as previously described, from the mud rod seat 116 in the upper portion of the bit shank. A retainer ring groove 118 is shown circumferentially extending around the outer periphery of the bit shank 112, and received therein is the superimposed combination of a top ring 120, a rubber retainer ring seal 122, and a bottom retainer ring 124, as shown. The bit shank 112 is also provided with vertically extending splines 126 above and below the retaining ring groove 118, which splines are also circumferentially spaced apart, as best shown in FIG. 7. A ledge portion 128 near the lower end of the bit shank provides a seat for the driver sub 104, and just below the circumferentially extending ledge 128 is a ball bearing track 130 for receiving suitable ball bearing means 132. The top surface 134 of the bit shank 112 forms the anvil upon which the impact surface 102 of the hammer 86 strikes.

As shown in FIGS. 8 and 9 a mud and fluid supply stem member 136 is provided for threaded engagement with the threaded portion of the top sub assembly 10. The supply stem is provided at its lower end with fluid mating slots 16, similar to those in the top sub, for communicating respectively with fluid intake exhaust passages 18 and 24. A collar 138 surrounds the mid portion of the stem 136 and is held in place by a C-clamp or washer means 140 which holds the collar against the ledge portion 141 at the upper portion of the stem 136. A fluid supply conduit 142 in the collar 138 communicates with the circumferentially extending intake groove 144 which in turn communicates with the fluid passage 18 extending through the drill stem, as previously described. After the fluid, preferably air, is routed through the drill stem it is exhausted out the exhaust passage 24 into the exhaust groove 146 and out the exhaust conduit 148. This routing of the operating fluid for reciprocating the hammer assembly takes place while the drilling mud flows through the central passage 26 to the drill bit and out from the drill bit and up the sides of the drill stem.

The operation of percussion drill assembly according to the invention is as follows: The hammer 86 receives a fluid, air for example, through intake passage 18 in the top sub 10 which then routes the air to the air distributor 40. The air is then dispersed through an air intake groove 42 which equally distributes the air flow into air intake ports 60 in the inner barrel 54. The air is then channeled through the intake chamber 76 in the barrel and released through intake ports 66 in the inner barrel 54, thus filling the air intake groove 88 in the piston or hammer 86. Air then flows through air slots 98 and into the exhaust chamber 92 after building up sufficient pressure to lift the piston 86. The chambered surface of the piston allows air to reach the exhaust ports 62 in the inner barrel 54, and simultaneously in the piston 86 the lifting action of the air is routed through the intake ports 66 which fills the intake groove 90 in the piston allowing air to travel through air slots 100 in the piston filling the exhaust chamber 94. Sufficient pressure will then be developed to force the piston 86 back into its firing position thus striking anvil 134 of the bit shank 112 and also allowing the chambered suface of the piston to expose exhaust port 64 and release air into exhaust chamber 78 (see FIG. 3) completing the piston function and starting the entire process over again.

The air flow is then released into the exhaust groove 44 through exhaust port 62. The air is then routed upward through the exhaust passage 25 in the air distributor which releases the air into the exhaust passage in the top sub 10 thus allowing the air to travel back up the drill stem (FIGS. 10 & 11).

At the same time drilling mud is pumped down through the drill stem 160 via the mud passage 26 into the top sub 10. The mud then enters the mud rod 80 which allows the mud to pass through the mud hammer or piston 86 and thence through the bit assembly 112 to thereby flush rock and cuttings out of the drilled hole around the outside of the drill stem without ever coming in contact with the air that operates the hammer assembly. By having the air and mud routed through the system in such a manner, that is, separate from one another, eliminates restriction of the air supply within the drill assembly because of outside pressure equalization during "flooding out" conditions and thus allows the drill assembly to go to greater depths with no decrease in the penetration rate.

It is also contemplated by the principles of the invention that in the event of the bit shank being fractured or shorn the drill assembly is designed to retrieve the broken bit that would otherwise be left in the well. For this purpose when the driver sub is placed over the shank of the bit 112, ball bearings 132 are inserted into the ball bearing tract 130. Thus, when lifting of the driver sub 104 occurs the lip portion 108 applies pressure on the ball bearings 132 thus creating a locking device for retrieving the bit.

As opposed to conventional drilling methods the design of drill stem and hammer according to the invention allows a driller to obtain a given depth without tripping out of the hole and replacing the hammer with a tricone bit. The invention thus allows the hammer to be operated on air separately from the flushing operation of the mud.

This operation will be more efficient because there will be less time spent on bit changes and tripping the drill stem out of the hole. Also, the invention which relieves air resistance will allow the air compressor to run with less of a load.

In some cases, it is necessary to reverse circulation, which means when excessive water is encountered in the hole or well one cannot use mud. The only way the hole can be drilled is to then apply air pressure into the hole, thus forcing the fluid and cuttings up the center of the drill stem, and for this purpose a tricone bit must again be used. The hammer according to the invention, however, is designed for this method of drilling, thus obviating the need to trip out of the hole and replace the hammer with a tricone bit.

The foregoing relates to a preferred embodiment of the invention, it being understood that other embodiments and variants thereof are possible within the spirit and scope of the invention, the latter being defined by the appended claims.

What is claimed is:

1. A percussion drill assembly for down hole drilling, comprising:

an elongated chamber defining a barrel assembly;

a top sub assembly connected to one end of said barrel assembly and having passage means therein including a flushing passage and separate intake and fluid exhaust passages adapted to be sealed from the flushing passage; a driver sub assembly connected to the other end of said barrel assembly;

a hammer assembly disposed within said chamber and having an axially extending flushing passage therein and fluid intake and fluid exhaust passages, said hammer assembly being disposed within said barrel assembly for reciprocal motion therein;

an anvil and bit shank assembly disposed within said chamber and having an axial flushing passage disposed within said driver sub assembly; said anvil and bit shank assembly adapted to be impacted upon by said hammer assembly;

a fluid distributing means disposed within said barrel assembly between said top sub assembly and said hammer assembly disposed to receive an operating fluid for causing reciprocal movement of said hammer assembly and having a flushing passage; said barrel assembly having passage means for interconnecting the fluid intake passages of the top sub assembly and the hammer assembly through the fluid exhaust passages of the distributing means and the fluid exhaust passages of the top sub assembly and the hammer assembly through the exhaust passages of the distributing means to exhaust operating fluid through the exhaust passages of the top sub assembly;

a tube extending through the flushing passage of said distributing means and said hammer assembly for passing a flushing fluid therethrough separate from said operating fluid and means for sealing the intake and exhaust passages from the flushing passages.

2. A drill assembly according to claim 1, wherein said barrel assembly comprises an inner barrel and an outer barrel coaxial therewith, said inner barrel having passage means operatively interconnecting said intake passages and exhaust passages of the distributing means and hammer assembly, and sealed with respect to said flushing passage allow said flushing fluid to be passed through said tube simultaneous with the application of the operating fluid for causing reciprocal movement of said hammer.

3. A drill assembly according to claim 1 wherein said operating fluid comprises air and said flushing fluid comprises a drilling mud.

4. A drill assembly according to claim 1, wherein said flushing passage in said top sub assembly and said flushing passage in said bit shank assembly are coaligned with said flushing passage in said hammer assembly.

5. A drill assembly according to claim 1, wherein said flushing passage in said top sub assembly said fluid intake and fluid exhaust passages in said top sub assembly are interconnected respectively to the flushing passage, fluid intake and fluid exhaust passage of said hammer assembly by said fluid distributing means and the passages of said barrel assembly.

6. A drill assembly according to claim 1, wherein said barrel assembly includes an inner barrel and an outer barrel coaxial therewith, said means for sealing including seals disposed about said tube above and below intake port means and exhaust port means in said inner barrel communicating with said operating fluid through said fluid distributing means, said inner and outer barrels defining operating fluid intake and exhaust chambers therebetween, and said hammer assembly including an intake groove and slot means communicating with an exhaust chamber, said exhaust chamber of said hammer assembly being defined by an annular space between the interior surface of said flushing passage of said hammer assembly and the exterior surface of said mud tube.

7. A percussion drill assembly for down hole drilling, comprising:

an elongated chamber defining a barrel assembly;

a driver sub assembly connected to one end of said barrel assembly;

a hammer assembly having an axially extending core therein said hammer assembly being disposed within said barrel assembly for reciprocal motion therein;

an anvil and bit shank assembly disposed within said driver sub assembly adapted to be impacted upon by said hammer assembly;

a fluid distribution means disposed within said barrel assembly adapted to receive an operating fluid for causing reciprocal movement of said hammer assembly;

fluid intake and exhaust passage means disposed within said barrel assembly and hammer assembly and being interconnected by said distribution means for passing the operating fluid therethrough to effect reciprocal movement of said hammer assembly; said exhaust passages being interconnected to effect exhaust of the operating fluid from the top of the barrel assembly and means for sealing the fluid intake and exhaust passages from the flushing fluid to allow passage of a flushing fluid simultaneously with but independent and separate from said operating fluid including a mud tube extending through said hammer assembly and distribution means.

8. A drill assembly according to claim 7, wherein said passage means in said core of said hammer assembly comprises a hollow drilling rod member.

9. A drill asssembly according to claim 7, wherein said barrel assembly includes an inner barrel and an outer barrel coaxial therewith, said inner barrel having intake port means and exhaust port means communicating with said operating fluid, and said inner and outer barrels defining an exhaust chambers therebetween, and wherein said hammer assembly includes an intake groove and slot means communicating with an exhaust chamber, said exhaust chamber of said hammer assembly being defined by an annular space between the interior surface of the passage in said hammer assembly and the exterior surface of said mud tube.

* * * * *

UNITED STATES PATENT AND TRADEMARK OFFICE

CERTIFICATE OF CORRECTION

PATENT NO. : 4,726,429

DATED : February 23, 1988

INVENTOR(S) : Kennedy et al

It is certified that error appears in the above-identified patent and that said Letters Patent is hereby corrected as shown below:

Column 6,
Claim 1, line 43, "exhaust" should be --intake--

Signed and Sealed this

Twenty-third Day of May, 1989

*Attest:*

*Attesting Officer*

DONALD J. QUIGG

*Commissioner of Patents and Trademarks*